US007150236B1

(12) United States Patent
Riley

(10) Patent No.: US 7,150,236 B1
(45) Date of Patent: Dec. 19, 2006

(54) PORTABLE WRITING PLATFORM FOR PROVIDING A STABLE WRITING SURFACE ADJACENT TO A BOOK

(76) Inventor: Alan E. Riley, 2011 Plant Ave., #B, Redondo Beach, CA (US) 90278

( * ) Notice: Subject to any disclaimer, the term of this patent is extended or adjusted under 35 U.S.C. 154(b) by 182 days.

(21) Appl. No.: 10/872,208

(22) Filed: Jun. 19, 2004

Related U.S. Application Data

(63) Continuation-in-part of application No. 10/617,242, filed on Jul. 9, 2003, now abandoned.

(60) Provisional application No. 60/395,390, filed on Jul. 15, 2002.

(51) Int. Cl.
*A47B 23/00* (2006.01)

(52) U.S. Cl. ..... 108/43

(58) Field of Classification Search ..... 108/43, 108/42, 25, 26, 143; 248/448, 444, 445, 248/451, 460, 461
See application file for complete search history.

(56) References Cited

U.S. PATENT DOCUMENTS 1,232,089 A * 7/1917 Riebe ..... 108/43
4,046,294 A * 9/1977 Morin ..... 224/247
5,388,530 A * 2/1995 Jacobus ..... 108/43
5,655,743 A * 8/1997 Gillis ..... 248/346.01
5,901,934 A * 5/1999 Wilson ..... 248/346.01
5,971,148 A * 10/1999 Jackson ..... 108/43
6,003,446 A * 12/1999 Leibowitz ..... 108/43
6,234,085 B1 * 5/2001 Ramundo ..... 108/43

FOREIGN PATENT DOCUMENTS

GB 2081572 A * 2/1982

* cited by examiner

*Primary Examiner*—Jose V. Chen
(74) *Attorney, Agent, or Firm*—Eric Karich

(57) ABSTRACT

A portable writing platform adapted to be used with a book includes a generally planar base adapted to be positioned around a portion of the book, an attachment member adapted for removably attaching the base to the book, a writing surface, and an adjustable attachment between the writing surface and the generally planar base. The adjustable attachment enables the writing surface to move between a stored position wherein the writing surface is adjacent the generally planar base, and an extended position wherein the writing surface extends outwardly from the generally planar base.

1 Claim, 2 Drawing Sheets

PORTABLE WRITING PLATFORM FOR PROVIDING A STABLE WRITING SURFACE ADJACENT TO A BOOK

CROSS-REFERENCE TO RELATED APPLICATIONS

This application for a utility patent is a continuation-in-part of a previously filed utility patent having the application Ser. No. 10/617,242, filed Jul. 9, 2003 now abandoned. This application also claims the benefit of U.S. Provisional Application No. 60/395,390, filed Jul. 15, 2002. Each of these related applications is incorporated herein by reference in its entirety.

STATEMENT REGARDING FEDERALLY SPONSORED RESEARCH

Not Applicable

BACKGROUND OF THE INVENTION

1. Field of the Invention

This invention relates generally to portable writing platforms, and more particularly to portable writing platforms adapted to be used with books.

2. Description of Related Art

Taking notes while reading a book generally requires writing on a piece of paper supported by a surface sufficiently flat and rigid enough to serve as a writing surface. A typical notebook or notepad includes several sheets of note paper attached to a cardboard backing. While the cardboard backing is typically sufficiently flat and rigid enough to serve as a writing surface, making notes in a notebook or on a notepad while reading a book requires supporting both the book and the cardboard backing. Writing with one hand while supporting both the notebook or notepad and the book with the other hand is cumbersome and quickly fatiguing.

A typical portable desk includes a flat surface supported by a base or leg members positioned on opposite sides. While folding or collapsible versions of portable desks are known, such portable desks are meant to be used in an open position with the base or leg members supported. Known portable desks are relatively large compared to a typical book.

It would be advantageous to have a portable writing platform that is relatively small compared to a typical book and is adapted to provide a supported writing surface positioned adjacent the book for making notes while reading the book. It would also be advantageous to have a method for providing a supported writing surface positioned adjacent a book for making notes while reading the book.

SUMMARY OF THE INVENTION

A disclosed portable writing platform is adapted to be used with a book and includes a generally planar base adapted to be positioned around a portion of the book, an attachment member adapted for removably attaching the base to the book, a writing surface, and an adjustable attachment between the writing surface and the generally planar base. The adjustable attachment enables the writing surface to move between a stored position wherein the writing surface is adjacent the generally planar base, and an extended position wherein the writing surface extends outwardly from the generally planar base. When the generally planar base is positioned around a portion of the book and the writing surface is in the extended position, the writing surface is operably positioned adjacent the book for writing thereupon while reading the book. A method for providing a stable writing surface adjacent to a book is also described.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
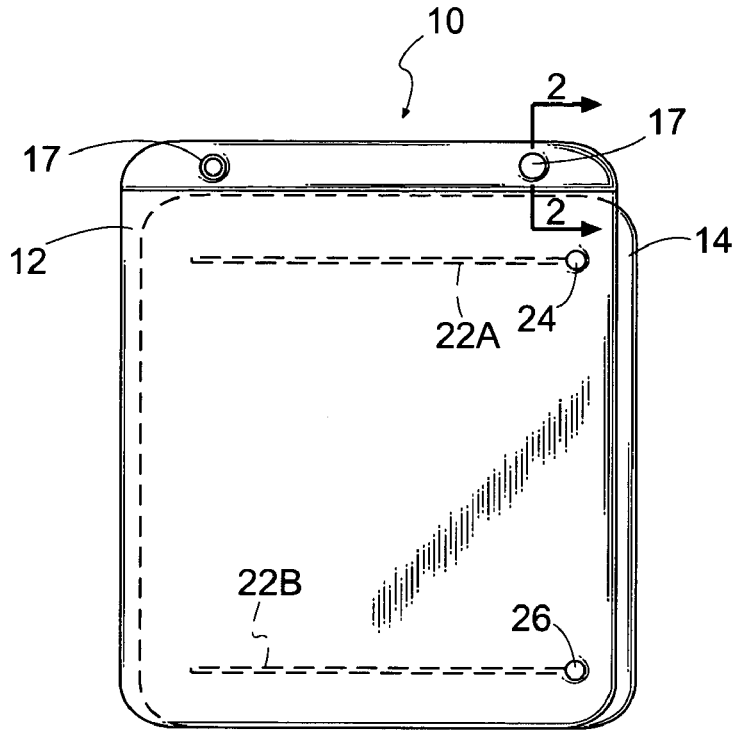
FIG. 1 is a perspective view of a portable writing platform in a collapsed, closed, or stored position.
Figure 2:
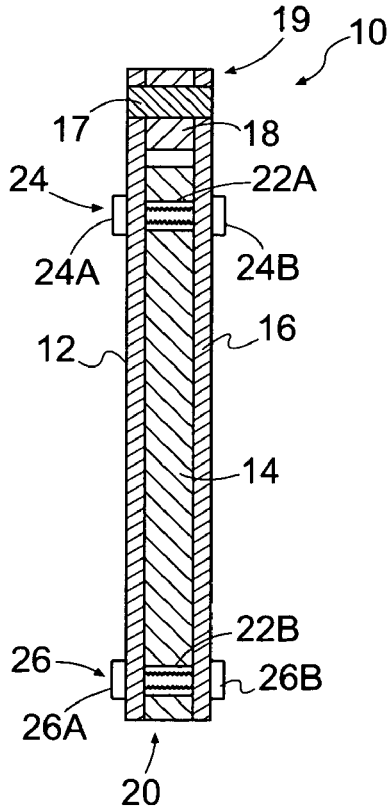
FIG. 2 is a sectional view thereof taken along line 2—2 in FIG. 1.
Figure 3:
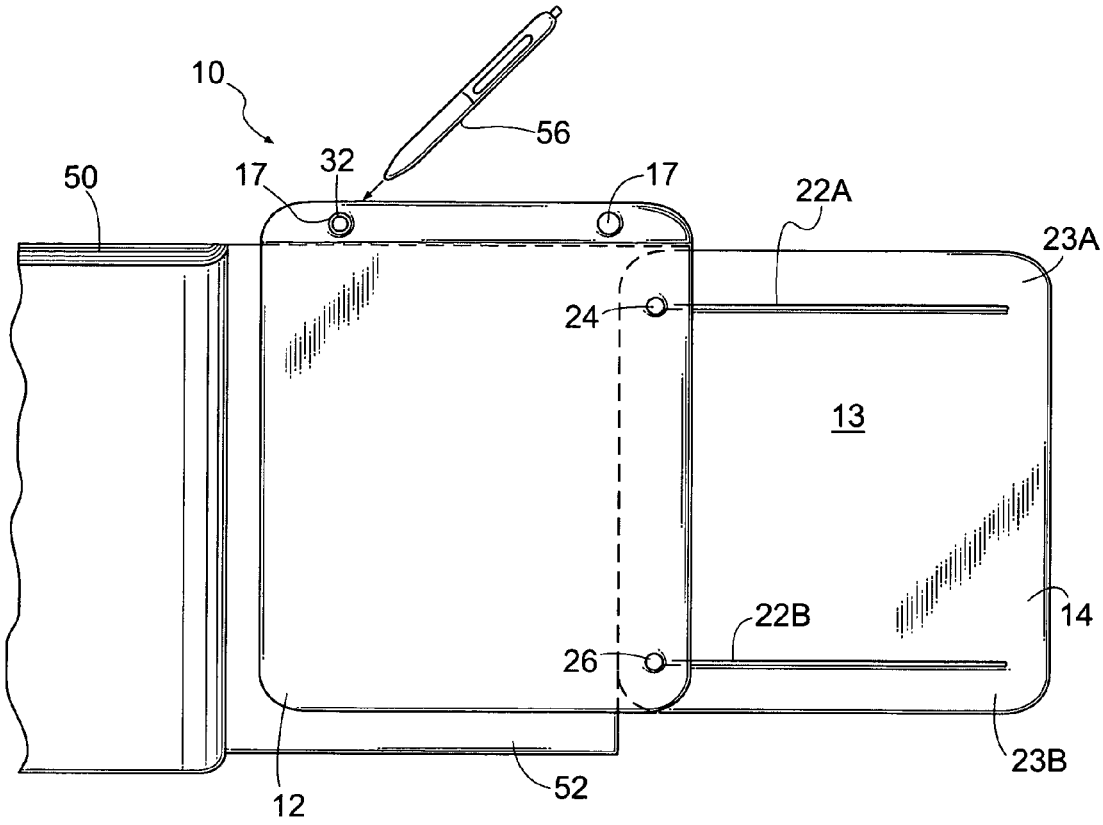
FIG. 3 is a perspective view of the portable writing platform of FIG. 1 in an extended or open position and installed over a back cover of a book.

FIG. 1 is a perspective view of a portable writing platform 10 in a collapsed, closed, or stored position. FIG. 2 is a sectional view thereof taken along line 2—2 in FIG. 1. As shown in FIGS. 1 and 2, the portable writing platform 10 includes a generally planar base 12 adapted to be positioned around a portion of the book (as shown in FIG. 3). The portable writing platform 10 also includes an attachment member adapted for removably attaching the base 12 to the book. As described in more detail below the portable writing platform 10 is adapted for attaching to a book, and can be used by both right-handed and left-handed users. The portable writing platform 10 is relatively small compared to a typical book, and is adapted to provide a supported writing surface positioned adjacent the book for making notes while reading the book.

In the embodiment of FIGS. 1 and 2, the generally planar base 12 is a first substantially planar cover member; and the attachment member is provided by a second substantially planar cover member 16 that is substantially parallel to the first substantially planar cover member 12. The portable writing platform 10 further includes a substantially planar sliding member 14 positioned between the cover members 12 and 16. In general, a major surface 13 of the sliding member 14 is adapted to function as a writing surface. (See FIG. 3.) The writing surface 13 of the sliding member 14 is preferably smooth and flat.

As shown in FIG. 2, a divider 18 is positioned between the two cover members 12 and 16 at a top portion 19 of the writing platform 10. The divider 18 and the two cover members 12 and 16 are fastened together with a rivet 17, staple, or similar connecting mechanism, or they are bonded together with a suitable adhesive. The divider 18 is dimensioned to create a channel 20 between the cover members 12 and 16 wide enough to receive the sliding member 14. As described in more detail below the sliding member 14 slides within the channel 20 and provides a writing surface in an extended or open position.

As shown in FIGS. 2 and 3, the channel 20 is also dimensioned to fit around a portion of the book 50. As shown in FIGS. 3, the portion of the book 50 could include a hard cover 52 of a typical hard-cover book. In the alternative, the portion could also be a combination of a paperback cover and several pages of the book 50. The covers of hard-cover books typically have thicknesses between about 0.02 inch and approximately 0.20 inch). Thus, in one embodiment, the sliding member 14 has a dimension between major surfaces (i.e., a thickness) of about 0.20 inch, the divider 18 has a thickness of about 0.20 inch, and the channel 20 created between the cover members 12 and 16 by the divider 18 has a dimension of about 0.20 inch.

In use, the book cover 52 is received in the channel 20 between the cover members 12 and 16. The cover members 12 and 16 and the sliding member 14 are preferably constructed of one or more rigid yet flexible materials that are resistant to breakage. Flexible plastic substances are suitable.

In the embodiment of FIG. 1 the cover members 12 and 16 are substantially identical. The portable writing platform 10 can be installed over a front cover of a book for left-banded writing, and over a back cover of the book for right-handed writing.

As indicated in FIG. 1 the sliding member 14 has a pair of slots 22A and 22B. The slots 22A and 22B are preferably substantially parallel to one another. The slot 22A is located generally in a top portion 23A of the sliding member 14, and the slot 22B is located in a bottom portion 23B of the sliding member 14. A first fastening device (i.e., fastener) 24 passes through a corresponding hole in the cover member 12, through the slot 24A, and through another corresponding hole in the cover member 16. A second fastener 26 passes through a corresponding hole in the cover member 12, through the slot 24B, and through another corresponding hole in the cover member 16. The fasteners 24 and 26 hold the cover members 12 and 16 and the sliding member 14 together, and holds the cover members 12 and 16 in a fixed position relative to one another.

The fasteners 24 and 26 can be loosened and tightened. When the fasteners 24 and 26 are loosened, the sliding member 14 is allowed to slide between the cover members 12 and 16 via the slots 22A and 22B. When the fasteners 24 and 26 are tightened, the fasteners 24 and 26 hold the cover members 12 and 16 and the sliding member 14 in a fixed position relative to one another.

In the embodiment of FIG. 2 the fastener 24 includes a first piece 24A having threaded stem and a second piece 24B having a cylindrical body with a hole threaded to receive the threaded stem of the first piece 24A. Similarly, the fastener 26 includes a first piece 26A having threaded stem and a second piece 26B having a cylindrical body with a hole threaded to receive the threaded stem of the first piece 26A. In general, the fasteners 24 and 26 may be viewed as a pair of posts that extend through the slots 22A and 22B of the sliding member 14 and can be tightened and loosened.

Other types of fasteners may be used in other embodiments. In other embodiments the fasteners 24 and/or 26 may be, for example, bolts and nuts or any other type of fastener that can be loosened and tightened. In a preferred embodiment, the fasteners are simple rivets that are used to fasten the sliding member 14 on the cover members 12 and 16.

In the embodiment of FIG. 1 the portable writing platform 10 is configured to fit over a back cover of a book and the sliding member 14 extends from a right side of the writing platform 10. Alternatively, the writing platform 10 is configured to fit over a front cover of a book such that the sliding member 14 extends from a left side of the writing platform 10.

A hole 32 in a top portion of the portable writing platform 10, extending through the cover members 12 and 16 and the divider 18, can be used to hold a writing instruments such as a pen or pencil. The hole 32 may also be used for hanging the writing platform 10 from a store shelf for display purposes. The hole 32 can also be used to mount attachments to the writing platform 10 such as lighting units for illuminating a book to which the writing platform 10 is attached, and also a writing surface of the sliding member 14. The hole 32 may also be used to hold a small recording device as are now commercially available.

In a preferred embodiment when the portable writing platform 10 is in the collapsed or closed position of FIGS. 1 and 2 the portable writing platform 10 is compact and portable enough to be used as a bookmark.

In general, the cover member 12 of FIGS. 1 and 2 is a planar base adapted to be positioned inside a book, and the cover member 16 functions as an attachment member that is adapted for removably attaching the base (i.e., the cover member 12) to the book. In an alternative embodiment the cover member 16 may be replaced by, for example, a spring-biased clip that clamps to a portion of the book such as a cover of the book.

In general, the fasteners 24 and 26 that fit into the slots 22A and 22B of the sliding member 14 function as adjustable attachments that enable the writing surface of the sliding member 14 to move between the stored position of FIGS. 1 and 2 and an extended position wherein the writing surface extends outwardly from the base. (See FIG. 3.) As described in more detail below, when the base is positioned inside the book and the writing surface is in the extended position, the writing surface is operably positioned adjacent the book for writing thereupon while reading the book. In an alternative embodiment of the portable writing platform 10 the sliding member 14 may include posts that engage corresponding slots in the base (i.e., the cover member 12). In yet another alternative embodiment the sliding member 14 may be attached to the base via a hinge.

FIG. 3 is a perspective view of the portable writing platform 10 of FIG. 1 in the extended or open position and installed over a back cover 52 of a book 50. In one embodiment, the fasteners 24 and 26 may be tightened, clamping a loose leaf paper (not shown) against the back cover 52. While this may be included in one embodiment, it is optional and not required in other embodiments of the invention. As a result the writing platform 10 is frictionally attached to the back cover 52 of the book 50, and the sliding member 14 extends outwardly from the right side of the back cover 52. An exposed writing surface 13 of the sliding member 14, preferably smooth and flat, is stable enough to function as a writing surface (e.g., for a right-handed user).

In general, the portable writing platform 10 is installed over the back cover 52 of the book 50 by loosening the fasteners 24 and 26, moving the sliding member 14 to the extended position such that the writing surface 13 is exposed, sliding the back cover 52 of the book 50 into the channel 20 (FIG. 2) between the cover members 12 and 16 vacated by the sliding member 14 such that the cover member 12 is inside the back cover 52 and the cover member 16 is outside the back cover 52, and tightening the fasteners 24 and 26 to clamp the back cover 52 between the cover members 12 and 16. As a result the writing surface 13 of the sliding member 14 is positioned adjacent to the back cover 52 of the book 50 as shown in FIG. 3 (e.g., for writing while reading the book 50). As described above, a pen 56 may be inserted into the hole 32 in a top portion of the portable writing platform 10 to hold the pen 56 when not in use.

The slot 22A can also be used to hold a pad of paper (not shown) in place by sliding a cardboard back of the pad though the slot 22A. This secures the pad to the sliding member 14 so that the pad will not move when a user writes on the pad. In one of the above-described embodiments, the fasteners 24 and 26 can be tightened can be tightened to hold the pad on the sliding member 14.

While the above-described structure represents one embodiment of the invention, those skilled in the art will recognize that alternative embodiments could also be adapted to practice the claimed invention. The generally planar base 12 could include a wide variety of shapes and sizes, as long as it is adapted to be positioned inside the book. The generally planar base 12 could also include a wide variety of additional clips, enhancements, or other features, and such alternatives should be considered within the scope of the claimed invention.

The attachment member could also include a wide variety of mechanisms and structures, from a simply clip to a more complicated mounting structure. Such alternatives should be considered within the scope of the claimed invention, as long as it is adapted for removably attaching the base to the book.

Likewise, the adjustable attachment between the writing surface 14 and the generally planar base 12 could also be provided by a wide variety of structures, as long as the structures enable the writing surface 14 to move between a stored position wherein the writing surface 14 is adjacent the generally planar base 12, and an extended position wherein the writing surface 14 extends outwardly from the generally planar base 12, and whereby when the generally planar base 12 is positioned inside the book 50 and the writing surface 14 is in the extended position, the writing surface 14 is operably positioned adjacent the book 50 for writing thereupon while reading the book 50.

Examples of alternative structures to the adjustable attachment include the inverse of the present construction, wherein the generally planar base 12 includes slots adapted to receive protrusions from the writing surface 14. Also, the adjustable attachment could include a hinged connection, or even a pivoting mechanism. Such alternative constructions should be considered within the scope of the claimed invention.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A portable writing platform adapted to be mounted on either a front cover or a back cover of a book, the portable writing platform comprising:

a pair of substantially planar cover members;

a substantially planar sliding member positioned between the cover members, having a surface adapted for writing, and having a channel; and at least one fastener for holding the cover members in a fixed position relative to one another and for slidably retaining the sliding member between the cover members, one of the fasteners extending through the channel of the planar sliding member, wherein the pair of substantially planar cover members are separated by a channel dimensioned to receive the sliding member therebetween, and wherein the sliding member slides to an extended position wherein the sliding member extends from between the pair of substantially planar cover members; and wherein the portable writing platform is adapted for installation over either the front cover or the back cover of the book such that the front or back cover is positioned between the pair of substantially planar cover members.

* * * * *